US005313550A

United States Patent [19]

Crosnier et al.

[11] Patent Number: 5,313,550

[45] Date of Patent: May 17, 1994

[54] STEAM HUMIDIFIER WITH MODULAR CONSTRUCTION AND ELECTRODES TO GENERATE STEAM

[75] Inventors: Daniel Crosnier, Offranville; Michel Mazire, Ambrumesnil, both of France

[73] Assignee: Devatec S.A., France

[21] Appl. No.: 967,845

[22] Filed: Oct. 28, 1992

[30] Foreign Application Priority Data

Oct. 28, 1991 [FR] France ..... 91 13454

[51] Int. Cl.[5] ..... H05B 3/60; F22B 1/30

[52] U.S. Cl. ..... 392/325; 392/333; 392/401; 392/402

[58] Field of Search ..... 392/325, 327, 326, 324, 392/402–406, 401, 400

[56] References Cited

U.S. PATENT DOCUMENTS

| | | | |
|---|---|---|---|
| 3,219,796 | 11/1965 | Graf et al. | 392/327 |
| 4,092,519 | 5/1978 | Eaton-Williams | 392/325 |
| 4,146,775 | 3/1979 | Kirchner et al. | 392/327 |
| 4,705,936 | 11/1987 | Fowler | 392/326 |

FOREIGN PATENT DOCUMENTS

| | | | |
|---|---|---|---|
| 0453385 | 10/1991 | European Pat. Off. . | |
| 1884009 | 10/1963 | Fed. Rep. of Germany . | |
| 1271282 | 6/1968 | Fed. Rep. of Germany | 392/325 |
| 2014338 | 10/1970 | Fed. Rep. of Germany . | |

*Primary Examiner*—Anthony Bartis

*Attorney, Agent, or Firm*—Lerner, David, Littenberg, Krumholz & Mentlik

[57] ABSTRACT

An electric steam humidifier of the type which includes electrodes (58, 59) immersed in a tank containing water (5) includes an upper portion (10) consisting of a housing (3) closed by a cover (2), a lower portion (11) consisting of a housing (6) placed on a base (7), with the housings (3) and (6) being identical and positioned symmetrically in relation to a horizontal plane. The housings are joined to a structural element (4) made of aluminum and approximately U-shaped, with the arms of the U forming a space (40) for receiving the tank. The housing (3) contains a compartment (36) into which water is supplied and which includes an aperture (37) for evacuation of steam and an aperture (35) which is fitted to a filling aperture (54) on the upper surface of the tank (5). The tank includes on one of its side surfaces below the medial plane of the tank but above its bottom with a drainage aperture (55). The drainage aperture is extended outwardly by a well (550) which is connected to a solenoid drainage valve (49) housed within a space which forms an extension of the tank receiving space (40).

12 Claims, 3 Drawing Sheets

STEAM HUMIDIFIER WITH MODULAR CONSTRUCTION AND ELECTRODES TO GENERATE STEAM

FIELD OF THE INVENTION

The present invention is directed to a steam humidifier incorporating a new design.

BACKGROUND OF THE INVENTION

Humidifiers are particularly used to regulate the hygrometry of the ambient air, either in workplaces or in areas in which merchandise is stored.

Such humidifiers are virtually all of the same design and use the same principle: namely they consist of a housing made of folded sheet metal and plastic enclosing the various electrical control means, and within which is located a steam tank or cylinder which is filled with water for the generation of steam.

The water, in which two or three electrodes supplied with alternating-current electrical power are immersed, is brought to its boiling point and converted into steam, which is evacuated by means of a length of tubing which opens onto the top of the tank. In order to preserve the initial properties of the water, and in order to prevent an excessive concentration of conductive mineral salts, a portion of the water, which is proportional to the amount of steam produced, is evacuated and replaced.

This type of humidifier has many disadvantages, particularly with regard to the evacuation of the water, with the evacuation being performed at the bottom of the tank, where the calcareous deposit gathers and thus clogs the evacuation valve, thereby causing equipment failure.

Furthermore, such tanks must be cleaned regularly, which requires that they be removed. This operation involves numerous handling steps, particularly the disconnection of the water inlet and water outlet lines, each of which has a clamping collar at each of its ends; the disconnection of the electrodes; the cleaning of the various parts; and finally reconnection of the entire assembly, without omitting the cleaning or replacement of the various filters and sealing joints.

Furthermore, it is necessary to design a different housing for each humidifier with a different capacity; and the assembly of such humidifiers takes a relatively long time.

The present invention makes it possible to remedy these disadvantages by proposing a steam humidifier which is very compact, which contains only a few fittings and connections, and which therefore is easy to assemble and to maintain, and furthermore whose manufacturing cost is very low.

SUMMARY OF THE INVENTION

The steam humidifier which is the object of the present invention consists of a housing, whose shape is generally parallelepipedal, consisting of an upper portion and a lower portion, between which is located a structural element made of aluminum, formed by extrusion, which incorporates various channels.

The upper and lower portions are housings which are in the form of compartments, and which are closed by a cover, including various means of connection to the channels of the aluminum structural element, as well as tubing for the evacuation of the steam, a solenoid valve to supply the incoming water, and various electrical connections.

The housing of the lower portion is identical to the housing of the upper portion, but is positioned symmetrically with respect thereto.

The tank consists of a receptacle whose upper portion contains male connector plugs, each of which is connected to an internal electrode; a conduit for evacuation of the steam; and a water-supply inlet aperture whose lower portion laterally contains an outlet for residual water.

The tank can be installed within the housing rapidly and safely, in a single motion; since the male plugs are connected within the upper housing, which contains female plugs provided for this purpose; the evacuation conduit is fitted onto the well to which the evacuation tubing is connected; the water-supply inlet aperture is connected to the water-supply well; and finally the water outlet is connected to a solenoid valve located on the aluminum structural element. Thus, the user can perform this operation in a backward and forward, then upward and downward, motion without any manual contact with a source of electricity or heat, as is the case with humidifiers in use today.

The fact that the water outlet is located laterally and not at the base of the tank makes it possible to avoid the clogging of the evacuation valve due to limestone or scale. When the tank becomes excessively dirty, it can be discarded or replaced by another tank.

In the case of a humidifier with a different capacity, it is sufficient to change the height of the aluminum structural element, with the cover and the base remaining the same, thereby making it possible to reduce stock on hand to tall or short housings and structural elements of various lengths.

The advantages and characteristics of the present invention will become clearer through the following description, which refers to the attached drawing on which a non-limitative embodiment of the invention is represented.

DETAILED DESCRIPTION

Figure 1:
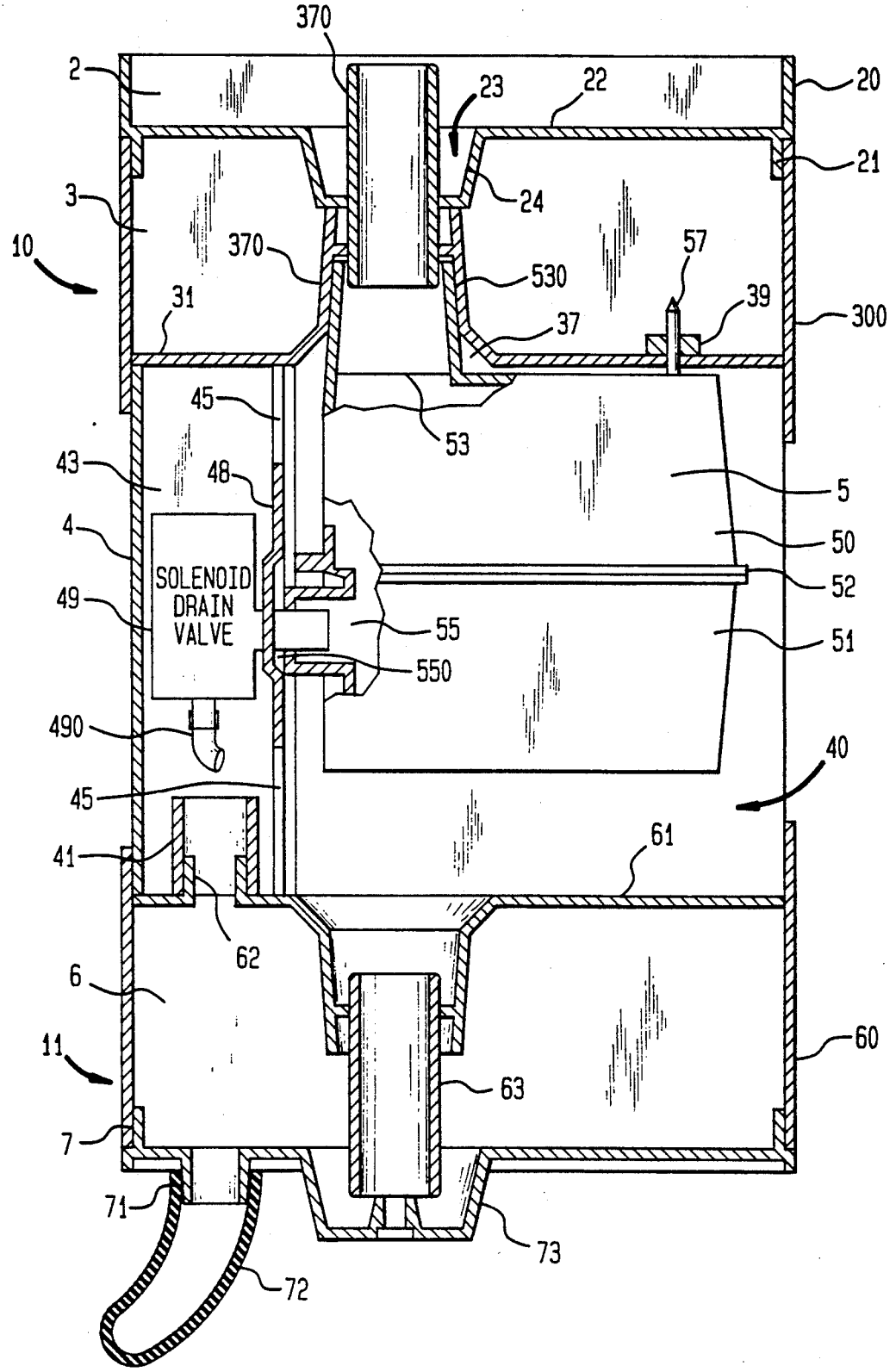
FIG. 1 represents a vertical profile and a sectional view, with partial cutaways along a vertical plane, of a humidifier in accordance with the invention.
Figure 2:
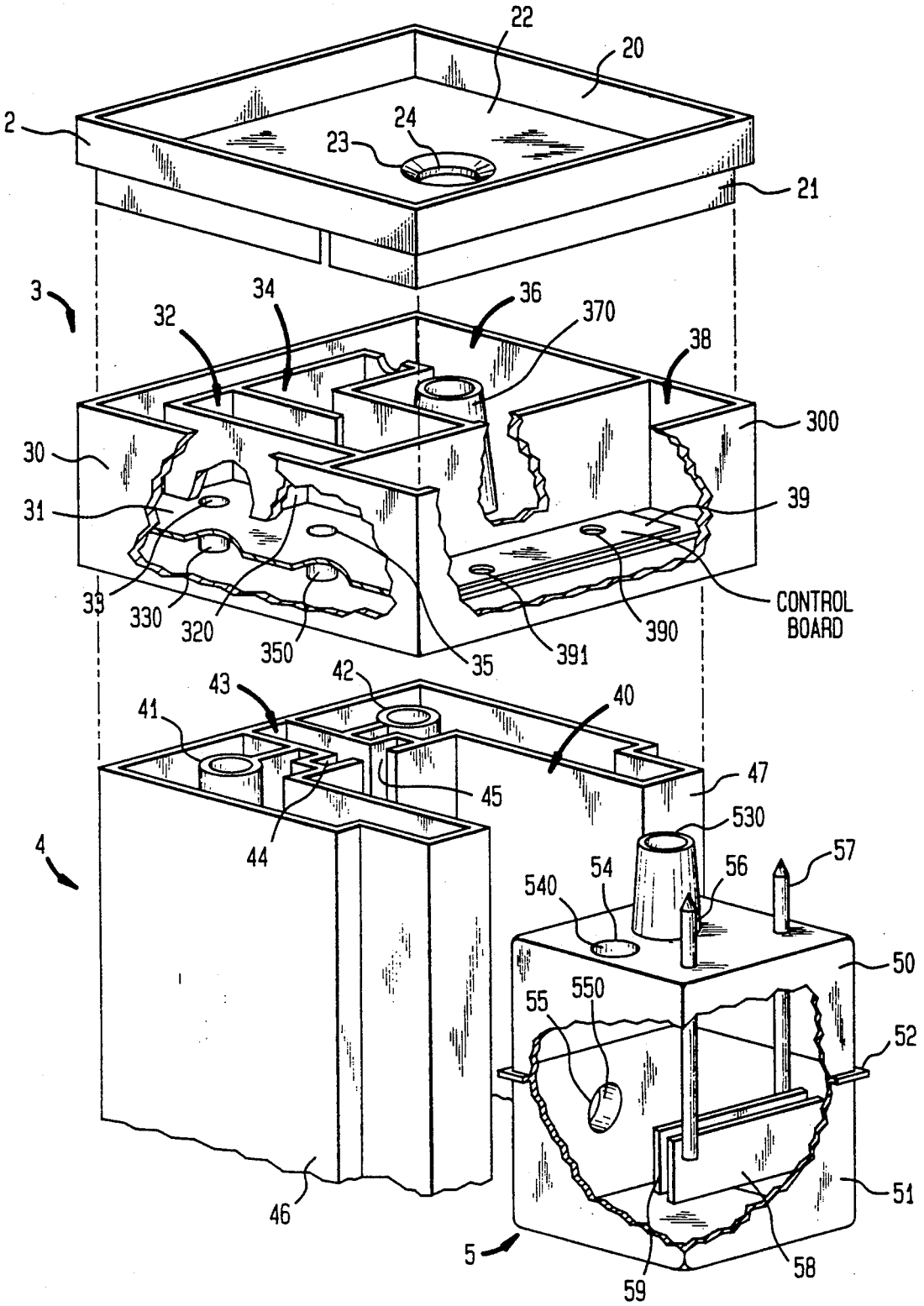
FIG. 2 represents a partial perspective and an exploded view, with partial cutaways, of said same humidifier.
Figure 3:
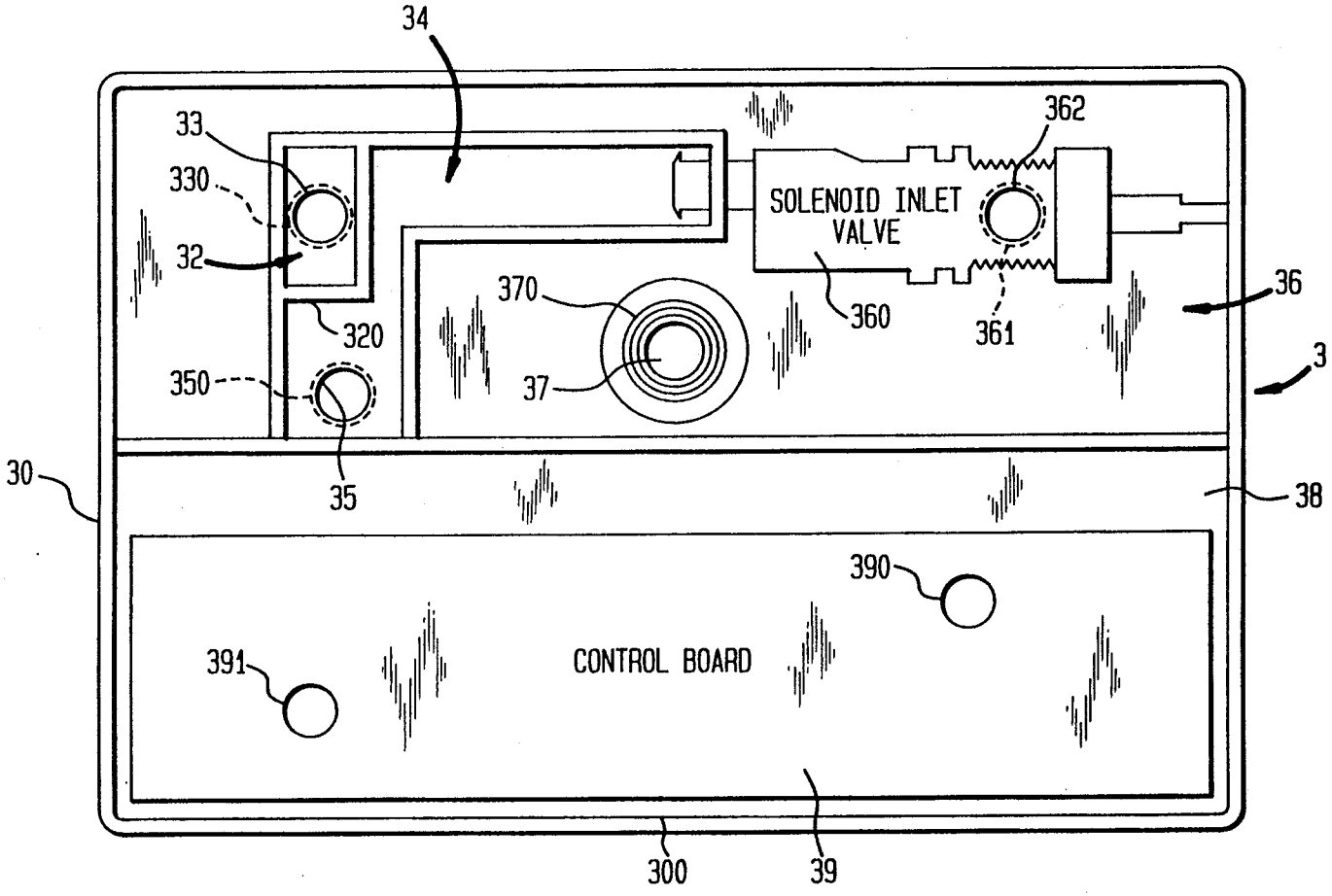
FIG. 3 represents a plan view of a housing which serves equally well as the upper or lower portion.

With reference to FIG. 1, FIG. 2, and FIG. 3, it can be seen that a humidifier in accordance with the present invention consists first of an upper portion (10) including a housing (3) surmounted by a cover (2); second, of a lower portion (11) consisting of a housing (6) which is identical to said upper housing (3) but positioned symmetrically; placed on a base (7); third, of an aluminum structural element (4) which is fixed in position between housings (3) and (6); and fourth, of a tank (5) located within structural element (4) below upper housing (3).

Cover (2) includes a bottom plate (22) around the periphery of which are joined integrally above the plate a wall (20), and below the plate a wall (21), wall (21) being (angled) inwardly in relation to wall (20) in such a way as to fit onto housing (3). Bottom plate (22) is pierced by an aperture (23) which is extended downwardly by a well (24). Housings (3) and (6) include bottom plates (31) and (61), respectively, around the periphery of which are integrally joined walls (30) and (60), respectively, whose respective lower and upper edges overlap bottom plates (31) and (61) to aluminum structural element (4).

Housing (3) is compartmented, as is housing (6); however, the compartments within the housings do not serve the same function.

A compartment (38) which is isolated from the rest of housing (3) and which is located within housing (3) contains the electronic control board (39) for humidifier, with the front panel (300) of wall (30) providing access to the various commands, such as power-on, start-up, adjustment, drainage, etc. for the humidifier.

A compartment (36) located at the back of housing (3) is designed to contain the water-supply inlet solenoid valve (360). Compartment (36) itself contains two compartments (32) and (34) which communicate with one another, which are separated by a low wall (320), and the bottoms of which contain apertures (33) and (35) respectively, which are extended downwardly, below bottom plate (31), by wells (330) and (350), respectively. In compartment (36), bottom plate (31) is also pierced by an aperture (361) which is extended downwardly by a well (362) (see FIG. 3), and by another aperture (37) which is extended upwardly by a well (370).

Aluminum structural element (4), which is formed by extrusion, includes two portions, (46) and (47), whose cross-section is L-shaped and which face one another, thus forming a space (40) in the front portion of humidifier, and a space (43), having a lesser volume, at the back portion thereof. Portions (46) and (47) are hollow, and within each of them a channel, (41) and (42), respectively, extends vertically.

Structural element (4) also includes two vertical grooves (44) and (45), located facing the separation line of spaces (40) and (43), and formed within portions (46) and (47), respectively. Vertical grooves (44) (45) are designed to receive a plate of sheet metal (48) to which is integrally joined a solenoid valve (49) located within space (43), plate (48) being able to slide vertically within vertical grooves (44) and (45).

Housing (3) is mounted on structural element (4) in such a way that the lower portion of wall (30) covers the upper edge of structural element (4) with well (330) of compartment (32) being inserted within vertical channel (41), and well (362) of compartment (36) being inserted within channel (42).

Cover (2) is positioned on housing (3), and well (370) ,of compartment (36) is inserted within aperture (23).

Housing (6) is mounted on the base of structural element (4) in the same way in which housing (3) is mounted on the upper portion of structural element (4). It can be seen in FIG. 1 that channel (41) opens into a well (62) which corresponds to well (362) of compartment (36) and opens into base (7) by means of an aperture (70) which is extended downwardly by a well (71) to which water-extraction tubing (72) is connected.

In housing (6) a well (63), corresponding to well (370) of housing (3), allows the recovery of residual water from any possible leakages, with well (63) opening into a small tank (73) in base (7), with the entire assembly forming a siphon.

Valve (49) is connected by means of a length of flexible tubing (490) to a well of housing (6) corresponding to well (350) of housing (3).

Tank (5) is formed by the assembly of an upper half-shell (50) and a lower half-shell (51), joined integrally together by their edges at a joint (52).

Upper half-shell (50) includes on its upper surface an aperture (53) which is extended outwardly by a well (530), and an aperture (54) which is extended inwardly by a well (540), and is traversed by two male plugs (56) (57) to which are soldered respectively electrodes (58) (59) located within tank (5).

Lower half-shell (51) is pierced laterally by an aperture (55) which is extended outwardly by means of a well (550).

The installation of tank (5) within the remainder of the device is performed first by introducing tank (5) into space (40) of structural element (4) and by connecting external well (550) of half-shell (51) to solenoid valve (49) carried by plate (48), with the hermetic qualities of the assembly being ensured by a tight sealing joint. Next, tank (5) is subjected to a movement upwardly from the bottom, with the plate of sheet steel (48) sliding in vertical grooves (44) and (45), and external well (530) of half shell (50) of said tank (5) being introduced into well (370) of compartment (36) of housing (3), with lower well (350) of compartment (34) being inserted into aperture (54) of half-shell (50), and plugs (56) (57) passing through the bottom plate (31) of housing (3) at compartment (38) by means of apertures (not shown), then passing through electronic board (39) by means of apertures (not shown), then passing through electronic board (39) by means of apertures (390) (391) in order to be connected to female plugs (not shown), with tank (5) then being held in position by means of fixative elements (also not shown).

The operation of humidifier in accordance with the invention is as described below: water is introduced into compartment (34) by means of solenoid valve (360) located in compartment (36), and flows into tank (5) through aperture (35) whose well (350) is connected to aperture (54) of tank (5).

In the event of an overflow of water into compartment (34), i.e., in the event that the water level exceeds the height of wall (320), excess water flows into compartment (32) and is evacuated by means of aperture (33) into channel (41) of structural element (4).

If by chance aperture (33), or channel (41), should become clogged, water overflow can exit from compartments (32) (34) and spread into compartment (36), from which it is evacuated into channel (42) by means of aperture (361).

Electrodes (58) (59), which are immersed in the water and to which power in the form of alternating current is supplied by means of male plugs (56) (57), covert the water into steam which is evacuated by means of aperture (53) and led toward the outside of humidifier successively by well (530) and well (370), to which a length of tubing (not shown) is connected. The water from various wells is recovered at various points and is collected in compartment (36) in order to be evacuated into channel (42) by means of aperture (361).

The evacuation of water, which contains an excessively high concentration of mineral salts, from tank (5) is performed by means of solenoid valve (49), which dips into the tank by means of aperture (55).

Because of the lateral position of aperture (55), the water which is transported by means of valve (49) is not charged with limestone or scale, which remains at the bottom of half-shell (51); therefore, valve (49) does not become dirty.

The water to be evacuated is poured into base (7), either by means of channels (41) and (42) of structural element (4), or by means of the length of flexible tubing (490) or by means of well (63), and then flows by means of well (71) into a multi-directional fitting (72).

Furthermore, when tank (5) is considered to have become excessively dirty with limestone or scale, it is sufficient to remove tank (5) and to replace it with another tank, with the dirty tank being either discarded or re-used after cleaning.

It is obvious that the present invention is not limited to the preceding description of one of its embodiments, which can undergo a number of modifications without thereby departing from the scope of the invention.

We claim:

1. A modular steam humidifier comprising:

an upper housing portion;

a lower housing portion;

a tank for holding water and including electrodes contained within said tank for immersion into said water for the creation of steam thereby, said tank including a top, a bottom, and a plurality of side-walls, and drainage means associated with at least one of said plurality of side walls above said bottom for the drainage of excess water from within said tank;

a structural element disposed between said upper and lower housing portions, said structural element having a recess therein to removably receive said tank;

means for supplying said water to said tank via said upper housing; and means for evacuating water vapor generated within said tank, said means for evacuating being in communication with said tank and said upper housing.

2. The humidifier as claimed in claim 1, wherein said upper housing portion and said lower housing portion are identical and positioned symmetrically in relation to a horizontal plane, said humidifier including a cover for said upper housing portion and a base member on which said lower housing member is placed.

3. The humidifier as claimed in claim 2, wherein said upper housing portion further includes a control compartment, and an electronic control board housed within said control compartment, said control board having a pair of apertures for receiving a pair of male plug members, said pair of male plug members being operatively connected to said electrodes contained within said tank.

4. The humidifier as claimed in claim 2, wherein said cover of said upper housing is provided with an aperture for connection with said evacuation well for the evacuation of said water vapor.

5. The humidifier as claimed in claim 1, wherein said means for supplying said water include a water supply compartment housed in said upper housing portion into which said water is supplied, a solenoid inlet valve for supplying said water to said water supply compartment, and a water inlet in communication with said water supply compartment for receiving said water from said solenoid inlet valve, said tank including a filling aperture on said top, and said water supply compartment including a water supply aperture extended downwardly in communication with said filling aperture;

6. The humidifier as claimed in claim 1, wherein said means for evacuating said water vapor includes an upper evacuation aperture in said upper housing portion, an upper evacuation well extending said upper evacuation aperture upwardly, a tank evacuation aperture in said top of said tank, and a tank evacuation well extending said tank evacuation aperture outwardly.

7. The humidifier as claimed in claim 6, wherein said drainage means includes a drainage aperture extending outwardly from said tank, a solenoid drain valve in communication with said drainage aperture, and a drain outlet in said housing, said solenoid drain valve being connected to said drain outlet, and said drain valve being disposed within said structural element.

8. The humidifier as claimed in claim 5, wherein said water supply compartment includes a pair of water overflow drainage apertures, and including a pair of a water overflow drainage wells extending downwardly from said pair of water overflow drainage apertures, said structural element including a pair of vertical channels, said pair of drainage wells, being joined to said pair of vertical channels.

9. The humidifier as claimed in claim 8, wherein said water supply compartment includes a first subcompartment, a second subcompartment, and a low wall therebetween, said first subcompartment being supplied with said water by said solenoid inlet valve and said second subcompartment being constructed to allow evacuation of overflow water supplied to said water supply compartment.

10. The humidifier as claimed in claim 9, wherein said lower housing portion includes first and second overflow wells corresponding to said overflow drainage wells of said upper housing portion, said overflow wells of said lower housing portion each being connected to said pair of vertical channels in said structural element for evacuating said overflow water.

11. The humidifier as claimed in claim 10, wherein said drainage means includes a length of flexible tubing connected to said solenoid drain valve, a drainage well for directing drainage from said lower housing portion into said base member, a bottom well in said base member for directing said drainage out of said base member, and a multi-directional fitting connected to said bottom well, whereby the recovery and evacuation of residual water is performed only at said base member.

12. The humidifier as claimed in claim 11, including a lower tank in communication with said base member, said drainage well opening into said lower tank to thereby channel any possible water leakages thereto.

* * * * *

UNITED STATES PATENT AND TRADEMARK OFFICE

CERTIFICATE OF CORRECTION

PATENT NO. : 5,313,550
DATED : May 17, 1994
INVENTOR(S) : Crosnier et al

It is certified that error appears in the above-indentified patent and that said Letters Patent is hereby corrected as shown below:

Column 2, line 67, "(angled)" should read --recessed--.

Column 3, line 54, delete ",".

Column 6, line 9, "1" should read --5--.

Signed and Sealed this

Twenty-third Day of August, 1994

*Attest:*

Bruce Lehman

BRUCE LEHMAN

*Attesting Officer*

*Commissioner of Patents and Trademarks*